US006971643B1

(12) United States Patent
Garrison

(10) Patent No.: US 6,971,643 B1
(45) Date of Patent: Dec. 6, 2005

(54) QUICK CHANGE JAW PLATES FOR MACHINE TOOL VICES

(76) Inventor: Arthur Lee Garrison, 20410 Lakeview Dr., Rogers, AR (US) 72756

( * ) Notice: Subject to any disclaimer, the term of this patent is extended or adjusted under 35 U.S.C. 154(b) by 0 days.

(21) Appl. No.: 10/692,094

(22) Filed: Oct. 23, 2003

Related U.S. Application Data

(63) Continuation of application No. 10/224,198, filed on Aug. 19, 2002, now abandoned.

(51) Int. Cl.[7] ..... B25B 1/24
(52) U.S. Cl. ..... 269/282; 269/283
(58) Field of Search ..... 269/279, 280, 269/282, 283, 284

(56) References Cited

U.S. PATENT DOCUMENTS 3,942,780 A 3/1976 Clement
4,045,010 A 8/1977 Arnold
4,798,371 A 1/1989 Wallisser
4,861,010 A 8/1989 Neil
5,150,888 A 9/1992 Durfee
5,489,090 A 2/1996 Leger
5,921,536 A 7/1999 Bernstein

*Primary Examiner*—Robert C. Watson

(57) ABSTRACT

A quick change vice jaw plate arrangement includes jaw plates that may be rapidly secured to and rapidly removed from the opposing jaws of a vice. The jaws of the vice includes spaced jaw plate retainers which each carry a retaining pin. Each retaining is biased toward the face of the jaw and includes a relatively narrow shank and a relatively wider head. Each jaw plate has spaced retention recesses including a wide portion for receiving the head of the retaining pin, a detent portion for detaining the head of the retaining pin and a narrow portion for guiding it from the wide portion to the detent portion. A jaw plate may be quickly secured to a vice jaw by placing the wide portions of the retention recesses over the jaw plate retainers and sliding the jaw plate until the heads of the retainer pins seat in the detent portions of the retention recesses. The jaw plate may be rapidly removed from the vice jaw by a reverse action in which the heads of the retainer pins pop back up into the narrow portions of the retention recesses and exit through the wide portions of the retention recesses.

6 Claims, 4 Drawing Sheets

QUICK CHANGE JAW PLATES FOR MACHINE TOOL VICES

CROSS REFERENCE TO A RELATED APPLICATION

This application is a continuation of U.S. patent application Ser. No. 10/224,198 filed Aug. 19, 2002, now abandoned.

FIELD OF THE INVENTION

This invention relates to a quick change jaw plates for machine tool vices.

BACKGROUND OF THE INVENTION

Computer numerical control (CNC) machines such as CNC multi-axis milling machines used primarily for machining metallic parts are costly but very productive. CNC machines fashion metal parts by performing programmed machining operations with a high degree of precision and repeatability. Accordingly, the productivity of a CNC machine depends in large part on the amount of time a machine is actually performing operations as opposed to the amount of time needed to change over from a job to a subsequent job. The time needed to change between jobs is known as change over time or set up time. The productivity of a CNC machine increases as change over time decreases.

In order to reduce change over time, CNC machine operators have adopted opposed jaw vices which carry removable jaw plates. Typically, the jaw plates are fashioned from blocks of an easily machinable material such as aluminum and are typically machined with features for securing a particular type of workpiece. The jaw plates typically include counter sunk bolt holes for receiving bolts so that the jaw plates may be bolted to the opposing jaws of a vice.

Unfortunately, the operations of installing and removing the bolts of bolt mounted jaw plates adds to change over time. Further, the bolt mounting of jaw plates does not result in the accurate, repeatable mounting of jaw plates. Accordingly, workpieces, when held by bolt mounted jaw plates, must be indicated in to determine their exact location and orientation in relation to the machine. Moreover, typical bolt mounted jaw plates are arranged so that bolts are open to the workpiece side of the jaw plate. This reduces the jaw plate area available for securing a workpiece and exposes the bolts and the counter sunk bolt holes to machine debris. What is needed is a jaw plate which can be changed over very quickly and which can be located relative to a vice with a high degree of accuracy and repeatability. What is also needed is a jaw plate which presents a gripping surface which is not interrupted by bolts and the countersunk bolt holes needed for receiving them.

BRIEF SUMMARY OF THE INVENTION

The aforementioned needs are addressed by providing quick change vice jaw plates which have no fastener openings on their exposed faces and which can be rapidly secured to and rapidly removed from the opposing jaws of a vice. The quick change vice jaw plates are for mounting to the jaws of a vice that include spaced jaw plate retainers. The jaw plate retainers each carry a protruding retaining pin which is biased toward the face of the jaw. Each retaining pin includes a narrow shank and a relatively wider head and a frustum cone shaped portion transitioning between the narrow shank and the wider head. Each jaw plate has spaced retention recesses for receiving the heads of the retaining pins. Each retention recess includes a wide portion for receiving one of the retaining pins, a relatively narrow slot portion having ramp shaped shoulders for pulling the head of the retainer pin away from the jaw face as the jaw plate slides relative to the vice jaw and a compatibly shaped detent portion for securely receiving the head of the retaining pin.

The quick change vice jaw plates may be quickly secured to the vice jaws by placing the wide portions of the retention recesses over the retaining pin heads and sliding the jaw plates until the retaining pin heads seat in the countersunk portions of the retention recesses. The jaw plates may be rapidly removed from the vice jaw by tapping on the jaw plates to cause the heads of the retainer pins to pop back up into the slot portions of the retention recesses thus making it possible to disengage the retaining pins through the wide portions of the retention recesses. Thus, jaw plates adapted for holding workpieces may be rapidly and repeatably mounted to a compatible vice jaw without the use of hand tools except for perhaps a common rubber mallet. Because it is not necessary to access the retaining pins with a tool when a quick change jaw plates is installed or removed, the retention recesses can be machined in an undercut fashion from the surfaces that mate with the vice jaw so that the workpiece mating surfaces of the jaw plates can be free of bores or recesses for accessing fasteners. This eliminates pockets for accumulating machining debris and frees additional surface area for fashioning part holding features.

DETAILED DESCRIPTION OF THE INVENTION

Figure 1:
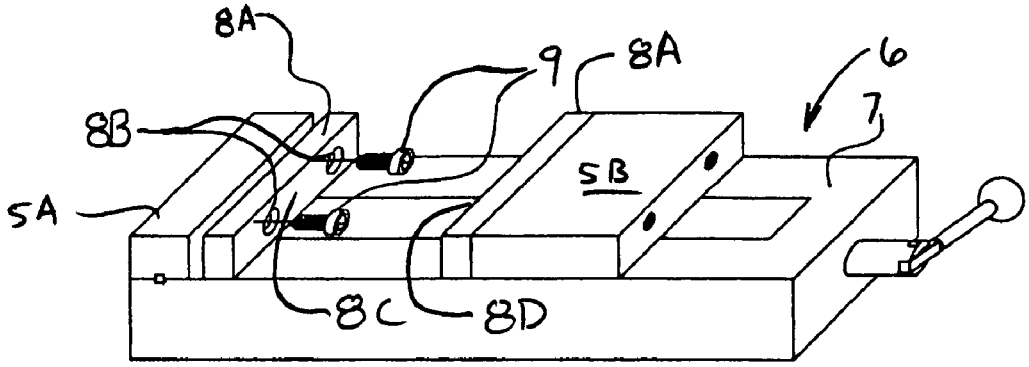
FIG.1 (PRIOR ART)
FIG. 1 is a perspective view of a prior art vice with prior art jaw plates.

Turning now to the drawings, wherein like reference numerals identify identical or corresponding elements, and more particularly to FIG. 1 thereof, a vice 6 is shown to include a base 7, a stationary vice jaw 5A and a translating vice jaw 5B. In FIG. 1, a prior art jaw plate 8A is shown aligned for mounting stationary vice jaw 5A. A second prior art jaw plate 8A is shown mounted to sliding vice jaw 5B.

Prior art jaw plate 8A includes countersunk holes 8B for receiving threaded fasteners 9. Stationary vice jaw 5A and sliding vice jaw 5B also include bolt holes (not shown) for receiving fasteners such as fasteners 9. With the prior art arrangement shown in FIG. 1, jaw plates 8A are bolted to stationary vice jaw 5A and translating vice jaw 5B. Preferably, jaw plates 8A and 8B are fashioned from an easily machinable material. Although not evident in FIG. 1, opposed workpiece clamping surfaces 8C and 8D of vice jaw plates 8A are typically machined with features which are uniquely shaped for engaging a compatibly shaped workpiece.

Figure 2:
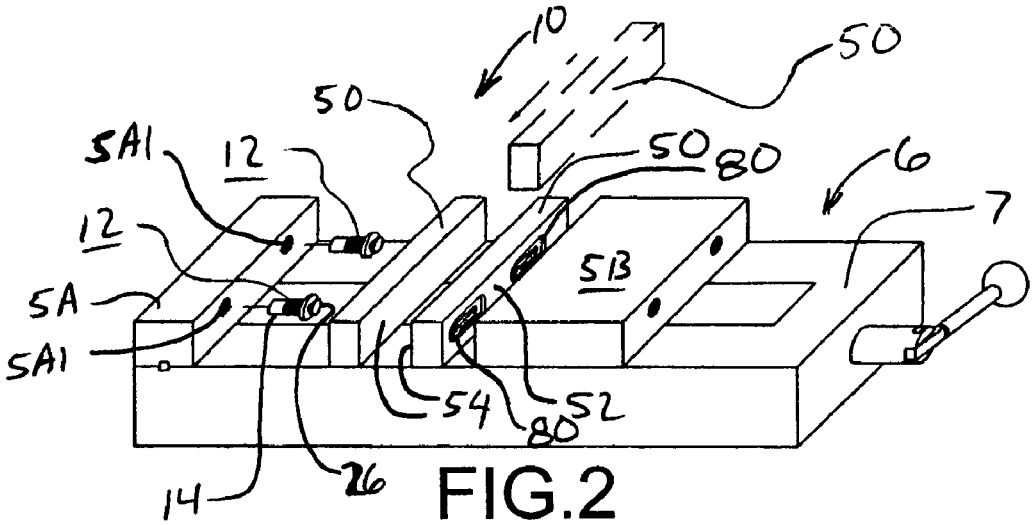
FIG. 2 is a perspective view of a vice with quick change jaw plates.
Figure 3:
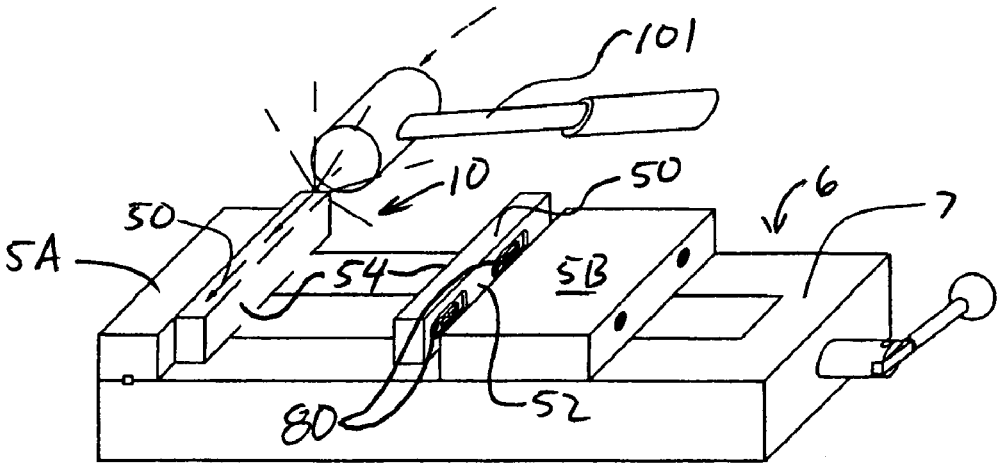
FIG. 3 is a perspective view of a vice with quick change jaw plates.

FIG. 2 illustrates the quick change jaw plate arrangement 10 of the present invention including vice 6 and jaw plates 50. Vice 6 of FIG. 2 also includes base 7, stationary vice jaw 5A and translating vice jaw 5B. With quick change jaw plate arrangement 10, fasteners 9A have been replaced by jaw plate retainers 12. Jaw plate retainers 12 are compatible with bolt holes 5A1. However, jaw plate retainers 12 differ from fasteners 9 of FIG. 1. Each jaw plate retainer 12 includes an externally threaded housing 14 with external threads like those of fasteners 9A. Housing 14 is generally hollow for carrying a biased retaining pin 26. Retaining pin 26 is biased so that it is pulled down into housing 14. Each jaw plate 50 includes a jaw mating surface 52, a workpiece clamping surface 54 and a pair of retention recesses 80. Generally, each retention recess 80 is undercut in jaw mating surface 52 and is shaped and located to receive and mate with the head of spring biased retaining pin 26 such that jaw plate 50 may be slid into a fixed, repeatable position, preferably by means of a the tapping action of a mallet 101 as shown in FIG. 3, and such that jaw plate 50 may also be easily disengaged by means of a strike from mallet 101 in a reverse direction from that shown in FIG. 3 and thereby removed from a vice jaw.

Figure 4:
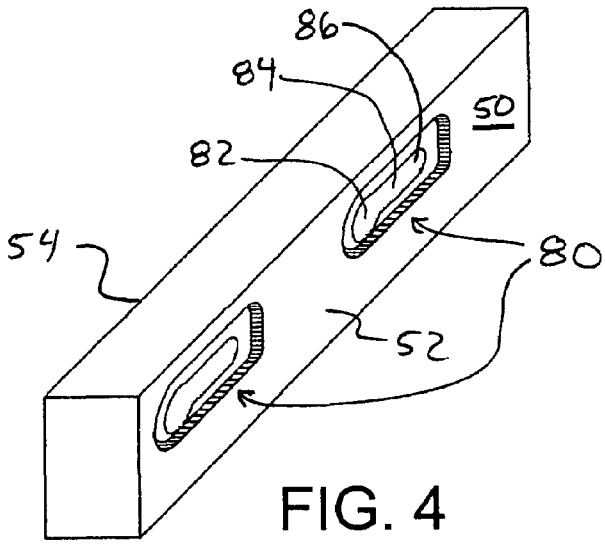
FIG. 4 is a perspective view of a quick change jaw plate.
Figure 4A:
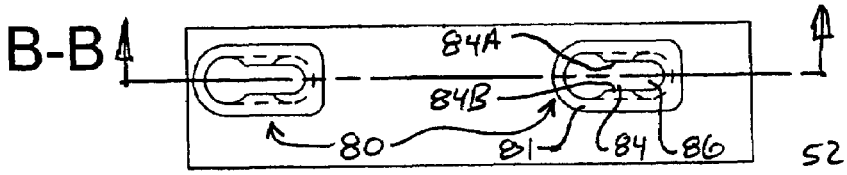
FIG. 4A is a side view of a quick change jaw plate.
Figure 4C:
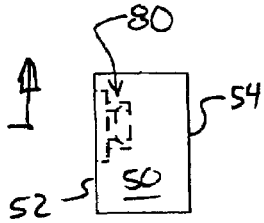
FIG. 4C is an end view of the quick change jaw plate of FIG. 4A.
Figure 4B:
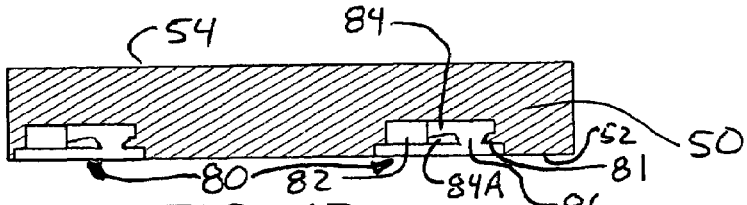
FIG. 4B is a cross section view of a quick change jaw plate taken from plane B—B of FIG. 4A.

FIGS. 4–4C, and FIGS. 7 and 8 provide more detailed views of jaw plate 50 and retention recesses 80. FIG. 4 shows that jaw plate 50 includes a workpiece clamping surface 52, a jaw mating surface 54 and retention recesses 80 which are spaced on jaw mating surface 54 to match the spacing of jaw plate retainers 12.

Each retention recess 80 is fashioned so that it can receive, retain and release the head of retaining pin 26. Retention recess 80 can be understood in a general fashion as including undercut features fashioned to define a receiving portion for receiving the head or retaining pin 26 and a guiding portion for guiding the head of retaining pin 26 to a pocket like detent portion which receives the biased head of retaining pin 26 and holds it in a fixed position. Also, generally, the detent portion of retention recess 80 is shaped so that when a sharp, jolting force, such as may be applied with a mallet, is applied to the jaw plate from the general direction of the retention recess receiving portion, retaining pin 26 pops up and out of the detent portion so that it can exit the retention recess.

A more detailed understanding of the geometry of retention recess 80, in the preferred embodiment, can be gained by referring to FIGS. 4–4C and FIGS. 7 and 8 and can be understood in a more particular fashion as including a recessed face 81, a relatively wide portion 82 for receiving the head of a retaining pin 26, a relatively narrow slot portion 84 and a detent portion 86. Relatively narrow portion 84 features opposite ramp shaped shoulders 84A and 84B which are spaced and shaped to receive and raise the head of retaining pin 14 against its bias. Shoulders 84A and 84B are spaced widely enough to receive the shank portion of retaining pin 26 but narrowly enough to catch the wider head portion of retaining pin 26. Detent portion 86 is compatibly shaped in the form of a cone frustum pocket for receiving and retaining the cone frustum shaped portion of retaining pin 26. The various above described features of retention recess 80 are shaped so that jaw plate 50 can be gently tapped into place as the heads of spaced retaining pins 26 slide up shoulders 84A and 84B of each respective retention recess 80 and then seat into each detent portion 86. This provides for the accurate repeatable location of jaw plates 50 in two axis parallel to the faces of the vice jaws. The pressure applied by the opposed vice jaws against the jaw plates prevents movement in the third axis. The various features of retention recess 80 are also shaped so that jaw plate 50 can be quickly removed by tapping on jaw plate 50 from the direction opposite countersunk portions 86 to cause the heads of retaining pins 26 to jump back up onto shoulders 84A and 84B of each retention recess 80 so that jaw plate 50 may be disengaged from jaw plate retainers 12.

Figure 5:
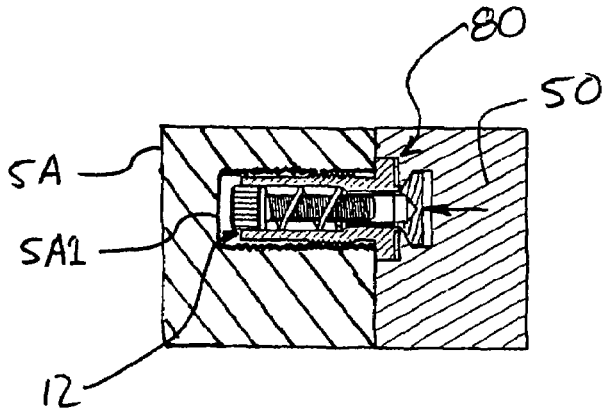
FIG. 5 is a cross section view of the quick change jaw plate, a vice jaw and a jaw plate retainer.
Figure 6:
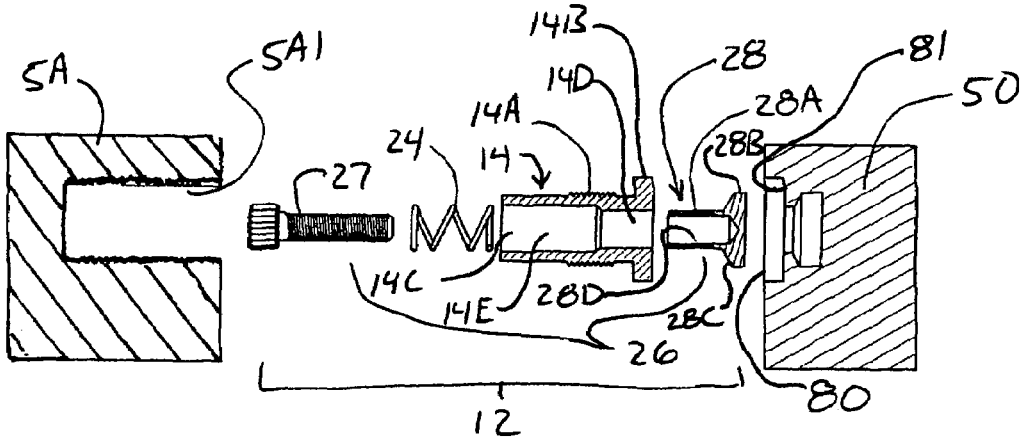
FIG. 6 is an exploded cross sectional view of the quick change jaw plate and a jaw plate retainer.
Figure 7:
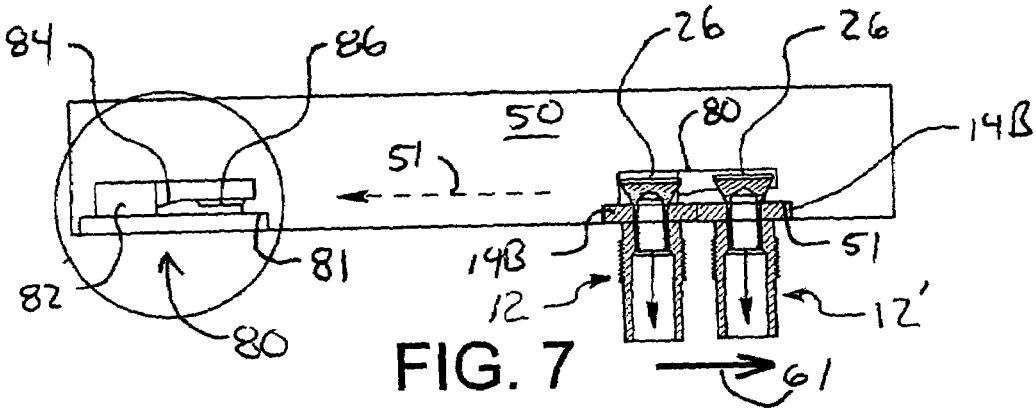
FIG. 7 is a longitudinal cross section view of the quick change jaw plate shown with an empty retention recess and a retention recess that has captured a jaw plate retainer.
Figure 8:
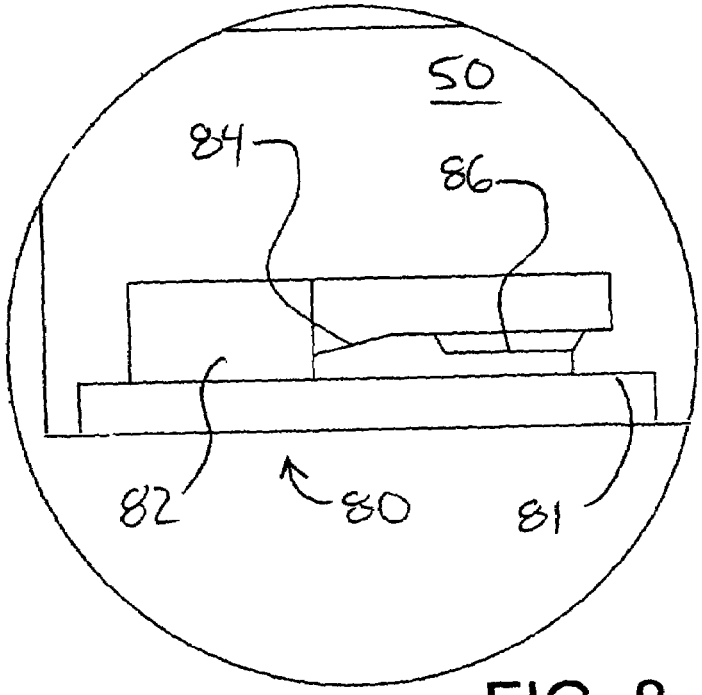
FIG. 8 is a magnified detail taken from FIG. 7 providing a magnified view of a retention recess.

FIGS. 5 and 6 provide detailed views of jaw plate retainer 12. Jaw plate retainer 12 generally includes a housing 14 which is externally threaded with external threads 14A for mating with a standard vice jaw bolt hole. Jaw plate retainer 12 also includes a protruding retaining pin 26 which can move within housing 14 between an extended position and a retracted position and which is biased toward the retracted position by a spring 24. As can be best seen in the preferred embodiment shown in FIG. 6, retaining pin 26 further includes a bolt portion 27 and a head portion 28. Head portion 28 includes a narrow shank 28A, a wider head 28B and cone frustum shaped portion 28C which transitions between shank 28A and head 28B. Shank 28A has a threaded bore 28D extending from its end for receiving bolt portion 27. Housing 14 further includes a radial flange 14B which is sized to fit within recessed face 81 of retention recess 80 and a central bore 14C. Central bore 14C of housing 14 is further divided into a narrow distal portion 14D and a wide proximal portion 14E. Distal portion 14D of bore 14C is machined to close tolerances to slidably receiving shank 28A of head portion 28 of retaining pin 26. Proximal portion 14E of bore 14C is fashioned to receive a compression spring 24 and bolt portion 27 of retaining pin 26. Compression spring 24 pushes against the head of bolt portion 27 thus biasing head portion 28 of retaining pin 26 in the same direction. As can be seen in FIG. 5, compression spring 24 pulls head portion 28 down into housing 14. If each head portion 28 of as spaced pair of retaining pins 26 are located within each detent portion 86 of a compatibly spaced pair of retention recess 80 as shown in FIG. 5, then jaw plate 50 will be accurately and repeatably mounted to vice jaw 5A.

Now that the various part of the quick change vice jaw have been described, the installation and removal of a quick change vice jaw can be considered. This description of the installation and removal of a quick change vice jaw will avoid plurals whenever possible. The reader should understand that this description relates to the installation of preferably two quick change vice jaws on opposed vice jaws and that vice jaws are preferably substantially identical and each preferably includes at least two retention recesses which are compatibly spaced to interface with at least two corresponding jaw plate retainers. It should also be understood that the jaw plate retainers may be threaded into at least two standard bolt holes 8A1 spaced apart by a standard distance and disposed in the opposing faces of the vice jaws. As noted above, jaw plate retainer 12 has an externally threading housing 14 and is adapted to mate with a typical threaded bores 8A1 of a vice jaws 5A shown in FIG. 2. Before a quick change jaw plates 50 can be mounted to vice jaw 5A or 5B, two jaw plate retainers 12 are threaded into bolt holes 8A1 such that each radial flange 14B is flush against the surface of vice jaw 5A.

Once, jaw plate retainers 12 are in place, it is possible to mount a jaw plate 50 to a vice jaw 5A. To understand the mounting of one jaw plate 50 it is best to consider the action of one retention recess 80 of a jaw plate 50 relative to one jaw plate retainer 12. To mount jaw plate 50 to a vice jaw such as vice jaw 5A, the jaw plate 50 is mated with a vice jaw so that a retention recess 80 is placed over a jaw plate retainer 12 so that flange 14B of jaw plate retainer 12 is received by recessed face 81 and such that head 28C of retention pin 26 is received by wide portion 82 of retention recess 80. Jaw plate 50 is tapped with a mallet from the opposite direction of wide portion 82 (in the direction shown by arrow 51 in FIG. 7) so that the ramped shoulders 84A and 84B of narrow portion 84 of recess 80 engage and pull against surface 28C of retention pin 26 to cause retention pin 26 to pull away from housing 14 of retainer 12. Head portion 28 of retention pin 26 slides up ramped shoulders 84A and 84B until head portion 28B is captured by detent portion 86 of recess 80. This motion is indicated by arrow 61 and the jaw plate retainer positions indicated by 12 and 12' in FIG. 7. At this point, when two retention pins 26 are located so that they are captured by respective, compatibly spaced detent portions 86, jaw plate 50 is retained against movement in the plane of the vice jaw face. If two opposite jaw plates which are retained in this manner are pressed together to hold a workpiece, their respective positions will be accurate and repeatable. Accordingly, if two opposite jaw plates are machined with special features for holding a particular workpiece, then the workpiece may be located relative to a machine in an accurate, repeatable manner thus eliminating the step of determining the position of the work piece in relation to the machine and thus reducing set up time as various jaw plates are interchanged between various machining tasks.

As can be seen from the above description of the installation of a quick change jaw plate 50, it is only necessary to position jaw plates 50 accurately and repeatably until vice jaws 5A and 5B apply a significant amount normal pressure which acts to hold the quick jaw plates 50 in a fixed position. When the pressure of vice jaws 5A and 5B is released, a jaw plate 50 can be removed with little effort. Accordingly, an operator can quickly remove a jaw plate 50 from a vice jaw such as vice jaw 5A with an action that is the reverse of the one described above. Namely, an operator may tap upon jaw plate 50 from the end opposite detent portions 86. This tapping on jaw plate 50 causes the head portions 28 of each retainer pin 26 to pop back up into the slot portion 84 of each retention recess 80. As the operator continues to tap or push on jaw plate 50, the head portions 28 of each retainer pin 26 proceed down the ramped shoulders 84A and 84B of each narrow portion 84 until head portions 28 align with the wide portions 82 of each retention recess 80. At this point, the operator may pull jaw plate 50 away from vice jaw 5A.

Thus, jaw plates 50 in combination with jaw plate retainers 12 solve the problems noted above. Jaw plates 50 may be rapidly removed and replaced with other jaw plates so that a vice for securing workpieces for machining operations may be quickly changed over between machining various parts. The corresponding frustum cone shaped features of detent portion 86 of recess 80 and head portion 28 of retention pin 26 make it possible to accurately and repeatably locate a particular jaw plate 50 on a particular vice jaw. When jaw plates are customized with specific features for securing particular workpieces, an operator using the jaw plates and jaw plate retainers of the present quick change jaw plate arrengment may repeatedly return to a machining task, mount a particular workpiece and then run CNC operations without the time consuming process of indicating in the position of the workpiece relative to the CNC machine. Moreover, since it is not necessary to access jaw plate fasteners as is the case with typical, prior art, jaw plates, the entire surface area of jaw plate 50 is available for holding a workpiece. This uninterrupted surface increases the versatility of the vice. The lack of workpiece side fastener holes further reduces change over time because there is no need to remove machining debris from workpiece side fastener holes. Accordingly, change over time is significantly reduced so that productivity of a CNC may be significantly increased.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A vice comprising, two opposing vice jaws, at least one of which may be translated relative to the other for grasping a workpiece between the opposing faces thereof, at least one the opposing faces of one of the vice jaws including at least one internally treaded bolt hole, at least one jaw plate retainer disposed in the at least one internally threaded bolt hole of the vice jaw face, the jaw plate retainer including an externally threaded housing for mating with the bolt hole of the vice jaw face and a retaining pin having a relatively narrow shank and a relatively wide head, the retaining pin movable within said externally threaded housing between a retracted position and an extended position and biased toward the retracted position, the jaw plate retainer fashioned such that at least a portion of the retaining pin head protrudes from the face of the vice jaw, a jaw plate for mounting to the at least one jaw plate retainer, the jaw plate including a retention recess having a detent portion for holding the head of the retaining pin in a fixed position, the retention recess also including a receiving portion for receiving the head of the retaining pin and a guiding portion for guiding the head of the retaining pin between the receiving portion and the detent portion as the jaw plate translates relative to the vice jaw, whereby the jaw plate may be positioned on one of the vice jaws by action of (i) placing the receiving portion of the retention recess to receive the head of the retaining pin, translating the jaw plate such that the guiding portion of the retention recess guides the head of the retaining pin toward the detent portion and aligning the detent portion with the head of the retaining pin such that the detent portion receives the head of the retaining pin and holds the retaining pin in a fixed position, thereby retaining the jaw plate in a fixed position and whereby the jaw plate may be removed from the vice jaw by a reverse action of translating the jaw plate such that the guiding portion of the retention recess receives the head of the retaining pin from the detent portion and guides the head of the retaining pin to the receiving portion so that the jaw plate may be pulled away from the vice jaw.

2. The device of claim 1, wherein, the retaining pin includes a relatively narrow shank and a relatively wider head and a cone frustum shaped portion connecting between the relatively narrow shank and the relatively wider head and wherein the detent portion of the retention recess includes a cone frustum shaped pocket for receiving the cone frustum shaped portion of the retaining pin.

3. A vice comprising, two opposed vice jaws, at least one of which may be translated relative to the other for grasping a workpiece between the opposing faces thereof, at least one jaw plate retainer mounted in the face of at least one of the vice jaws, the jaw plate retainer including a retaining pin having a relatively narrow shank and a relatively wide head and a cone frustum shaped portion between the shank and the head, the retaining pin movable between a retracted position and an extended position and biased toward the retracted position, the jaw plate retainer and the retaining pin fashioned so that at least a portion of the retaining pin head protrudes out from the face of the vice jaw, a removable jaw plate for mounting to the at least one jaw plate retainer including a retention recess having a wide portion, a relatively narrow portion and a detent portion, the wide portion for receiving the head of the retaining pin, the relatively narrow portion having shoulders that are spaced wide enough to receive the shank of the retaining pin and spaced narrow enough to catch the sides of the cone frustum shaped portion of the of the retaining pin, the shoulders also ramp shaped for urging the head of the retaining pin away from the face of the jaw as the jaw plate is translated relative to the vice jaw and the detent portion having a cone frustum shaped walls for receiving the cone frustum shaped portion of the retaining pin, whereby the jaw plate may be rapidly secured to one of the vice jaws by action of (i) placing the wide portion of the retention recess over the head of the retaining pin, (ii) applying a force to the jaw plate from the direction of the detent portion of the retention recess thus sliding the jaw plate relative to the vice jaw as the shoulders of the slot portion pull the biased retaining pin away from the vice jaw, (iii) continuing to slide the jaw plate as the biased retaining pin head pulls toward the jaw face and down into the detent portion of the retention recess, and whereby the jaw plate may be rapidly removed from the vice jaw by action of (i) applying a force to the jaw plate from the direction opposite the detent portion of the retention recess causing the head of the retaining pin to pop out of the detent portion of the retaining recess up into the slot portion of the retaining recess, (ii) sliding the jaw plate to align the retaining pin with the relatively wide portion of the retaining recess and (iii) translating the jaw plate away from the vice jaw.

4. The device of claim 3, wherein, the face of the vice includes at least one bolt hole, the jaw plate retainer further comprises a housing which is externally threaded for mating with the bolt hole and wherein the retaining pin moves within the housing between a retracted position and an extended position and is spring biased within the housing toward the retracted position.

5. A vice comprising, two opposed vice jaws, at least one of which may be translated relative to the other for grasping a workpiece between the opposing faces thereof, two pairs of jaw plate retainers mounted in the opposing faces of the vice jaws, the jaw plate retainers each including a retaining pin having a relatively narrow shank and a relatively wide head and a cone frustum shaped portion between the shank and the head, each retaining pin movable between a retracted position and an extended position and biased toward the retracted position, the jaw plate retainers fashioned so that at least a portion of the retaining pin heads protrude out from the faces of the vice jaws, removable jaw plates for mounting to the jaw plate retainers including retention recesses spaced for receiving the retaining pins of the jaw plate retainers, the retention recesses each having a wide portion, a relatively narrow portion and a detent portion, the wide portion for receiving the head of one of the retaining pins, the relatively narrow slot portion having shoulders that are spaced widely enough to receive the shank of one of the retaining pins and spaced narrowly enough to catch the cone frustum portions of the retaining pins, the shoulders also ramp shaped for urging the head of each retaining pin away toward the extended position and the detent portions of the retention recesses each having a cone frustum shaped for receiving the cone frustum shaped portion of the retaining pin, whereby one of the jaw plates may be rapidly secured to one of the vice jaws by in an accurate and repeatable fashion by action of (i) placing the wide portion of the retention recesses over the heads of the retaining pins, (ii) applying a force to the jaw plate from the direction of the detent portions of the retention recesses thus sliding the jaw plate relative to the vice jaw as the shoulders of the narrow portions of the retention recesses pull the biased retaining pins toward their extended positions, (iii) continuing to slide the jaw plate as the biased retaining pins pulls toward the jaw face and down such that the heads of the retaining pins seat into the dent portion of the retention recesses, and whereby the jaw plate may be rapidly removed from the vice jaw by action of (i) applying a force to the jaw plate from the direction opposite the detent portions of the retention recesses causing the heads of the retaining pins to pop out of the detent portions of the retaining recess up into the slot portions of the retaining recesses, (ii) sliding the jaw plate to align the retaining pins with the relatively wide portions of the retaining recesses and (iii) translating the jaw plate away from the vice jaw.

6. The device of claim 5, wherein, the face of each vice jaw includes two spaced bolt holes, the jaw plate retainers each further comprising a housing which is externally threaded for mating with the bolt holes and wherein the retaining pins moves within the housing between a retracted position and an extended position and is biased by a spring within the housing toward the retracted position.

* * * * *